United States Patent [19]

Leone et al.

[11] Patent Number: 4,876,424

[45] Date of Patent: Oct. 24, 1989

[54] BARRIER WITH A VENTING SCHEME FOR A CIRCUIT BREAKER

[75] Inventors: David A. Leone; Clifford A. Buxton, both of Lawrenceville; W. Dale Robbins, Snellville, all of Ga.

[73] Assignee: Siemens Energy & Automation, Inc., Alpharetta, Ga.

[21] Appl. No.: 246,484

[22] Filed: Sep. 19, 1988

[51] Int. Cl.[4] ..... H01H 9/30

[52] U.S. Cl. ..... 200/306; 200/144 R; 335/22

[58] Field of Search ..... 200/304, 305, 306, 144 R, 200/149 R, 149 A; 335/6, 132, 201, 202

[56] References Cited

U.S. PATENT DOCUMENTS

| | | | |
|---|---|---|---|
| 2,408,352 | 9/1946 | Titus | 200/144 R |
| 3,270,170 | 8/1966 | Fehrenbach et al. | 200/144 R |
| 3,553,613 | 1/1971 | Turnbull et al. | 335/202 |
| 4,075,446 | 2/1978 | Aadahl | 200/306 |
| 4,229,630 | 10/1980 | Wafer et al. | 200/144 |
| 4,242,577 | 12/1980 | Maier et al. | 200/153 |
| 4,388,506 | 6/1983 | Murai et al. | 200/304 |
| 4,484,045 | 11/1984 | Seymour et al. | 200/144 R |
| 4,580,021 | 4/1986 | Fujikake | 200/153 |
| 4,581,511 | 4/1986 | Leone | 200/306 |
| 4,672,157 | 6/1987 | Neel et al. | 200/144 |
| 4,764,650 | 8/1988 | Bur et al. | 200/306 |

FOREIGN PATENT DOCUMENTS

| | | | |
|---|---|---|---|
| 537190 | 2/1957 | Canada | 200/304 |

*Primary Examiner*—Henry J. Recla
*Assistant Examiner*—Glenn T. Barrett
*Attorney, Agent, or Firm*—James G. Morrow

[57] ABSTRACT

A barrier for isolating the electrical contacts of a circuit breaker from the operating mechanism for the contacts. The barrier includes openings to allow the operating mechanism to pass through the barrier, and venting channels for venting gas from within the circuit breaker to the exterior of the circuit breaker.

7 Claims, 4 Drawing Sheets

BARRIER WITH A VENTING SCHEME FOR A CIRCUIT BREAKER

BACKGROUND OF INVENTION

This invention relates to the molded case housing for a circuit breaker, and more particularly, to a barrier and venting arrangement for a molded case circuit breaker.

Normally, when a circuit breaker interrupts a fault current, the arc(s) produced during interruption generates hot ionized gases which must be vented from the circuit breaker to avoid rupturing the circuit breaker housing. In a multi-pole circuit breaker, the ionized gas, due to its low dielectric strength, can increase the probability of a fault between the poles of the circuit breaker. Additionally, the ionized gas increases the probability of the occurrene of an arc between the contacts of a circuit breaker and the operating mechanism of a circuit breaker. In addition to having a low dielectric strength, the ionized gas has a substantial amount of energy which is important to disburse.

One way of isolating the current carrying parts of a circuit breaker is illustrated in U.S. Pat. No. 4,242,577. FIGS. 1 and 2 of U.S. Pat. No. 4,242,577 illustrate an insulating barrier for electrically insulating the contacts from the operating mechanism and the toggle means of the circuit breaker. The provision of a barrier within a circuit breaker provides a means for preventing arcing between the operating mechanism and the contacts of a circuit breaker.

While a barrier within a circuit breaker may provide means for inhibiting arcing between the operating mechanism and the contacts of a circuit breaker, it is also important to provide a way of venting hot ionized gases from the circuit breaker. Normally this is done by providing a separate venting channel adapted to vent the ionized gas to the exterior of the circuit breaker housing. A problem with venting hot ionized gas to the exterior of a circuit breaker is keeping the gas away from the line terminals at the exterior. This prevents arcing across the circuit breaker terminals due to the low dielectric strength of the gas.

In addition to providing venting for hot ionized gases, it is useful to provide a means for deionizing and reducing the energy of the ionized gas. An example of deionizing plates is found in U.S. Pat. No. 4,672,157 which illustrates an arc chute fitted with deionizing plates.

SUMMARY OF THE INVENTION

An object of the present invention is to provide a barrier means which is integral with a venting channel, wherein the barrier is adapted to be combined with means for absorbing and/or dispersing energy from gas vented from the circuit breaker housing.

Accordingly, there is provided an improved barrier for a circuit breaker. The barrier is adapted for use in a circuit breaker of the type including a housing, at least one pair of contacts, means for separating the contacts and means for coupling one contact to the means for separating the contacts. The barrier includes a partition for isolating the means for separating the contacts from the contacts and at least one channel portion for facilitating the venting of gases from within the housing.

An advantage of the present invention is that it provides a single member which provides a partition and at least one channel for gas venting. Another advantage of the invention is that the channel can be modified to include means for deionizing and extracting energy from vented gases. Still another advantage of the present invention is that the channel can be used to provide a relatively long path to stretch an arc to aid in extinguishing the arc.

Various other objects and advantages of the present invention will become apparent from the following description, with reference to the accompanying drawing.

DETAILED DESCRIPTION OF THE PREFERRED EMBODIMENT

Figure 1:
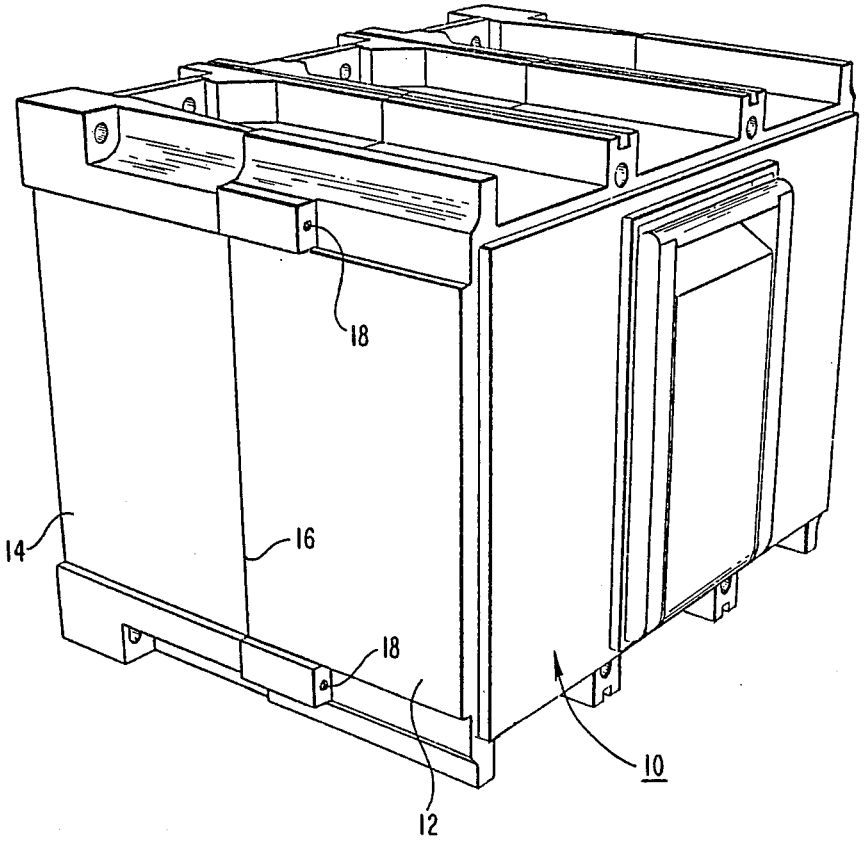
FIG. 1 is a perspective view of a circuit breaker housing.

Referring now to FIG. 1, FIG. 1 illustrates a molded housing 10 for a circuit breaker including two case portions 12, 14. When the case portions 12, 14 are joined together a seam 16 is formed at the junction between the portions 12, 14. To restrain the portions 12, 14 from moving apart, fasteners such as bolts can be placed into the openings 18 such that the threaded portions of the bolts extend into associated threaded openings in the portion 14. (Similar openings and threaded portions are used on the side of the molded housing opposite to the side illustrating the seam 16.)

Figure 2:
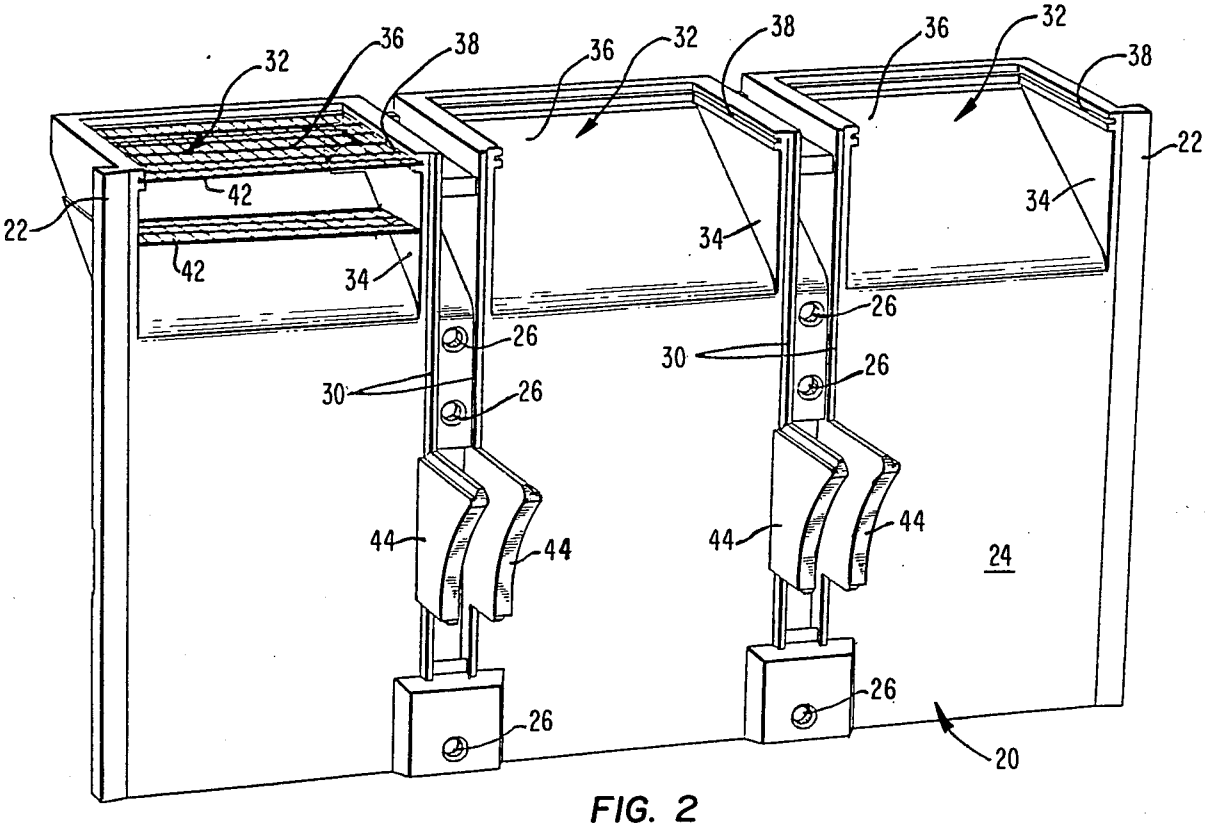
FIG. 2 is a front perspective view of a barrier and venting arrangement.
Figure 3:
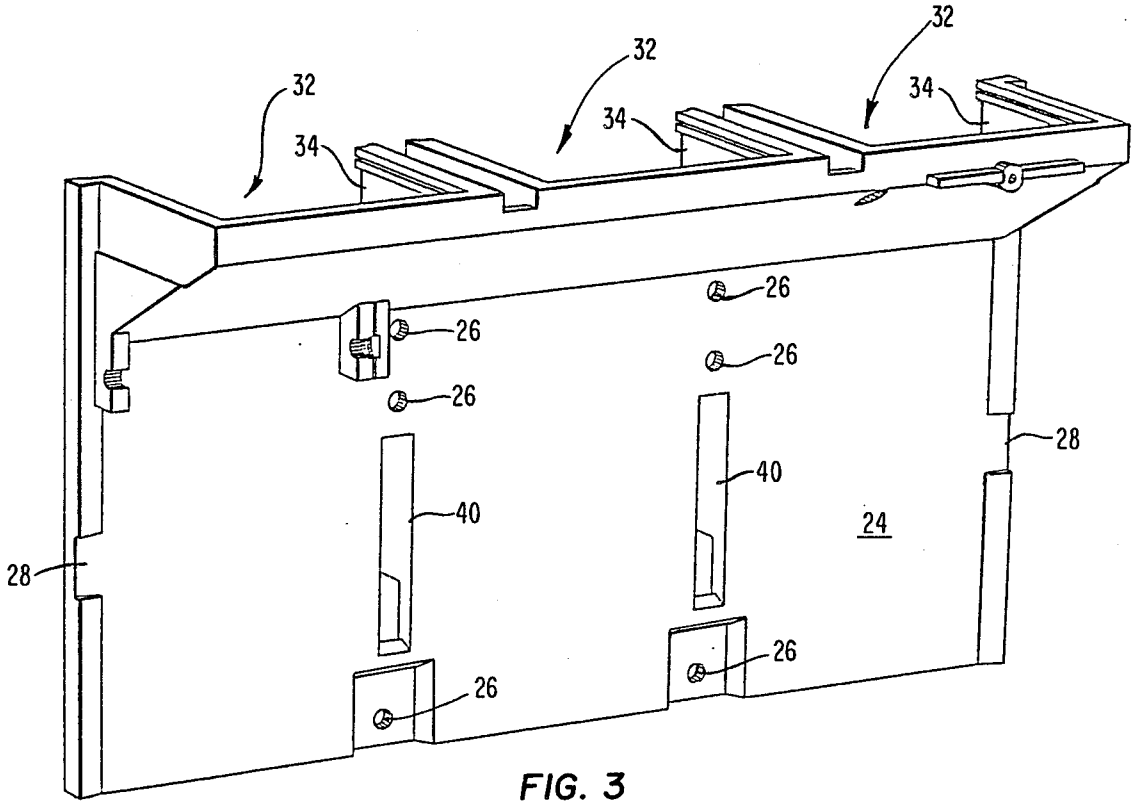
FIG. 3 is a rear perspective view of a barrier and venting arrangement.
Figure 4:
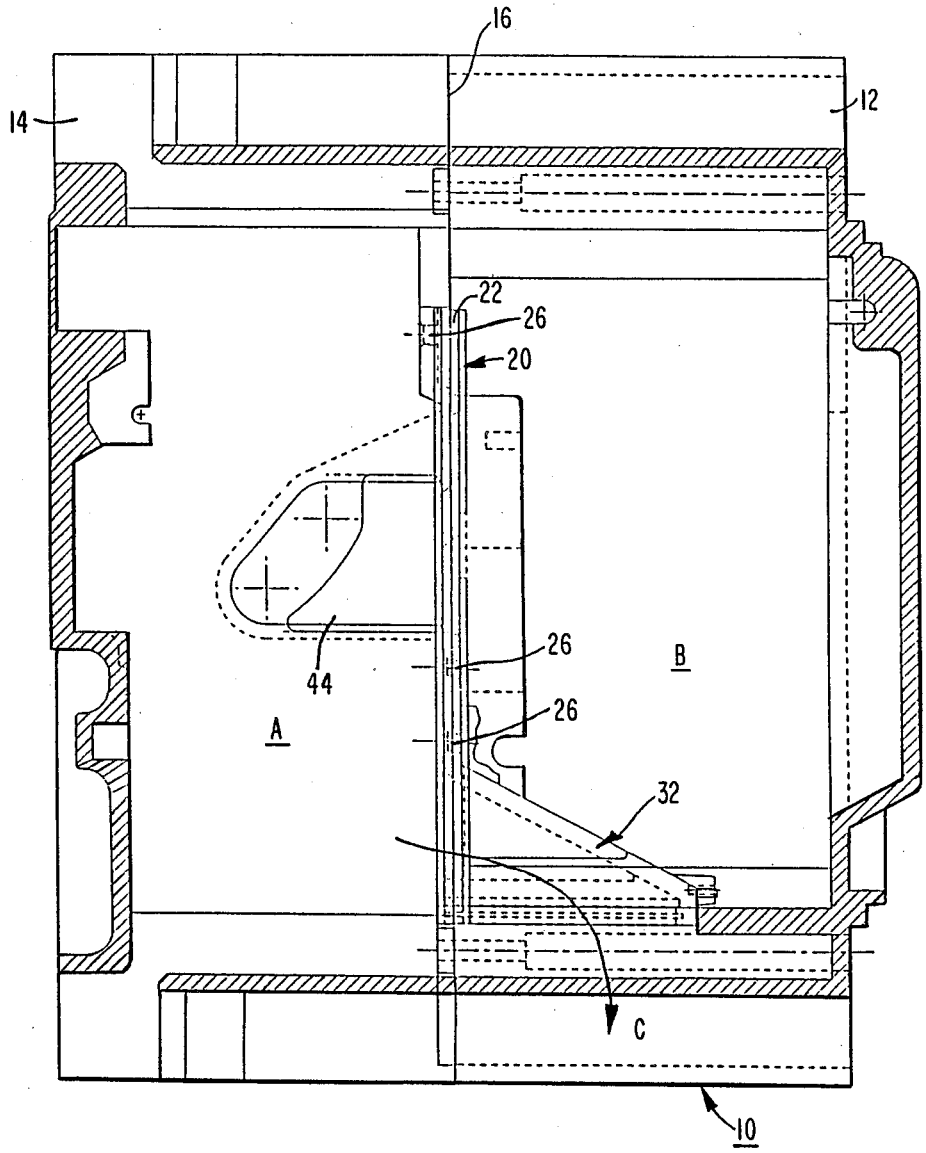
FIG. 4 is a side view of the barrier and venting arrangement situated within the housing.

The preferred embodiment of the barrier and venting arrangement 20 illustrated in FIG. 2, includes members 22 adapted to support the arrangement 20 at the junction between the portions 12, 14. The members 22 are interposed between the portions 12, 14 and assist in positioning and supporting the arrangement 20 at the seam 16.

The barrier portion 24 of the arrangement 20 includes a plurality of holes 26 adapted to accept fasteners (not shown) for positioning and attaching the arrangement 20 upon the portion 14. The barrier portion 24 also includes alignment slots 28 which assist in positioning the arrangement 20 between the housing portions 12, 14. In FIG. 2, the holes 26 are illustrated as lying between rail members 30. These rail members 30 assist the fasteners in maintaining the position of the arrangement 20 upon phase dividing walls (not shown) of the portion 14. The rail members 30 also provide additional phase to phase insulation by interlocking with the phase dividing walls.

The venting portions 32 of the arrangement 20 each include sidewalls 34, a rear wall 36 and engagement slots 38. The sidewalls 34 and rear walls 36 cooperate to provide a channel for venting gases to the exterior of the housing 10 generally along path C. The sidewalls 34 and rear walls 36 also cooperate with the barrier portion 24 to isolate the circuit breaker contacts (not shown) from the contact opening and closing mechanism (not shown). The contacts would normally be located within compartment A and the contact opening and closing mechanism would normally be located within compartment B.

To provide a means for dispersing energy from vented gases, the venting portion 32 can be combined with metallic screens 42 or plates. These screens 42 cool the gases by absorbing heat energy from gases. In addition, the screens 42 can be fabricated such that they deionize the gases.

Since compartments A and B are isolated, the barrier portion 24 provides for openings 40 adapted to allow a linkage to pass through the barrier portion 24 such that the contact opening and closing mechanism can be coupled to the contacts which are movable. The openings 40 are bordered by insulating barriers 44 for providing insulation means for the linkages.

While one embodiment of a barrier has been shown and described in detail herein, various other changes and modifications may be made without departing from the scope of the present invention.

We claim:

1. A circuit breaker comprising:

a housing including a first molded portion and a second molded portion, wherein the portions define a seam when joined; and a barrier support within the housing between the portions at the seam, the barrier and the first molded portion being adapted to enclose a means for contact opening and closing such that the means is substantially isolated from the contacts, the barrier and the second molded portion being adapted to enclose a first contact and a second contact, the first contact being coupled to the means for contact opening and closing, the barrier being formed integrally with a means for facilitating gas venting from within the housing.

2. The circuit breaker of claim 1, wherein the barrier includes at least one opening through which a means for coupling the first contact to the means for contact opening and closing can pass.

3. The circuit breaker of claim 2, wherein the means for facilitating gas venting from within the housing includes at least one channel which is an integral part of the barrier.

4. The circuit breaker of claim 3 further comprising means for absorbing energy from gases, the means for absorbing energy being disposed within the channel.

5. A housing assembly for a circuit breaker of the type including a housing, at least one pair of contacts, means for separating the contacts and means for coupling one contact to the means for separating the contacts, the housing assembly comprising:

a first molded housing portion;

a second molded housing portion engageable with the first molded housing portion such that the housing portions form a seam at their interface when joined; and a barrier for isolating the contacts from the means for separating the contacts, wherein the barrier comprises at least one channel portion for venting gas from within the housing and means for fixing the barrier within the housing betwen the housing portions at the seam, the channel portion being integrally formed with the barrier.

6. The housing assembly of claim 5, the barrier further comprising means for absorbing energy from gases, the means for absorbing energy being disposed within the channel portion.

7. The housing assembly of claim 5, the barrier further comprising at least one opening through which the means for coupling can pass.

* * * * *